US006168150B1

(12) United States Patent
Hori et al.

(10) Patent No.: US 6,168,150 B1
(45) Date of Patent: Jan. 2, 2001

(54) SHEET FEEDER UNIT

(75) Inventors: Haruhiko Hori, Okazaki; Yasuo Nakamura, Toyokawa, both of (JP)

(73) Assignee: Minolta Co., Ltd., Osaka (JP)

( * ) Notice: Under 35 U.S.C. 154(b), the term of this patent shall be extended for 0 days.

(21) Appl. No.: 08/990,291

(22) Filed: Dec. 15, 1997

(30) Foreign Application Priority Data

Dec. 25, 1996 (JP) ..... 8-346011
Dec. 25, 1996 (JP) ..... 8-346012

(51) Int. Cl.[7] ..... B65H 3/52

(52) U.S. Cl. ..... 271/121; 271/124; 271/161; 271/167

(58) Field of Search ..... 271/121, 124, 271/161, 167, 126, 18

(56) References Cited

U.S. PATENT DOCUMENTS

| | | | | |
|---|---|---|---|---|
| 5,026,042 | * | 6/1991 | Miller | 271/121 |
| 5,377,970 | * | 1/1995 | Kikuchi | 271/121 |
| 5,485,991 | * | 1/1996 | Hirano et al. | 271/121 |
| 5,520,381 | * | 5/1996 | Lo et al. | 271/121 |
| 5,527,029 | * | 6/1996 | Bortolotti et al. | 271/124 |
| 5,626,334 | * | 5/1997 | Kondo et al. | 271/161 |
| 5,711,519 | * | 1/1998 | Bortolotti | 271/121 |
| 5,769,411 | * | 6/1998 | Nakagawa et al. | 271/122 |
| 5,813,669 | * | 9/1998 | Horii | 271/124 |

FOREIGN PATENT DOCUMENTS

| | | | | |
|---|---|---|---|---|
| 3508270 | * | 9/1986 | (DE) | 271/121 |
| 0694490 | | 1/1996 | (EP) . | |
| 0694491 | | 1/1996 | (EP) . | |
| 0697358 | | 2/1996 | (EP) . | |
| 0145946 | * | 11/1980 | (JP) | 271/124 |
| 0202228 | * | 11/1983 | (JP) | 271/167 |
| 0264140 | * | 11/1987 | (JP) | 271/121 |
| 0026618 | * | 2/1991 | (JP) | 271/121 |
| 403264431A | * | 11/1991 | (JP) | 271/161 |
| 7-196186 | | 8/1995 | (JP) . | |

* cited by examiner

*Primary Examiner*—H. Grant Skaggs
(74) *Attorney, Agent, or Firm*—Sidley & Austin

(57) ABSTRACT

A sheet feeder unit being capable of separately supplying cut sheets of any thickness without causing any residual deformation. Cut sheets (11) in a pile are advanced one by one with a pair of feeding rollers (31) contacting thereto from one side thereof. A friction member (33) is disposed in the middle between the pair of feeding rollers (31) which is backed away by a proceeding cut sheet (11) thereby separating the outermost cut sheet (11) from the other sheets by the frictional force of contact therebetween.

5 Claims, 4 Drawing Sheets

FIG. 6A
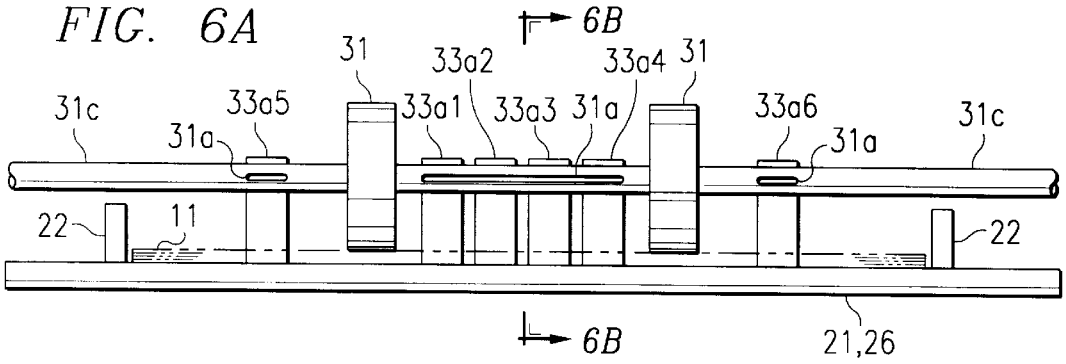
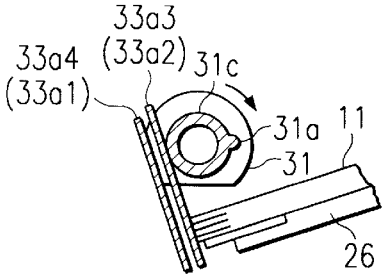
FIG. 6B
FIG. 7
(PRIOR ART)
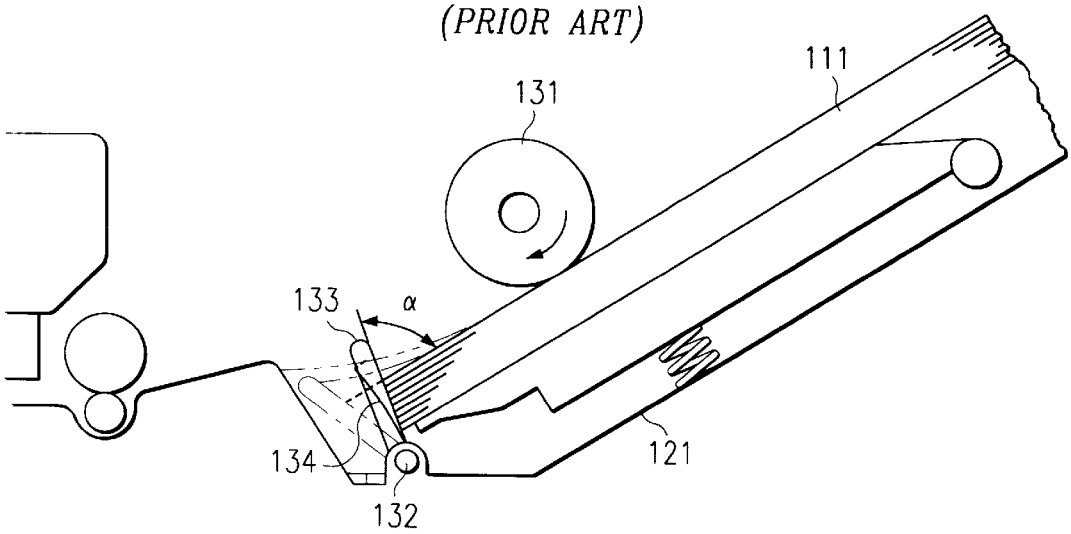

SHEET FEEDER UNIT

BACKGROUND OF THE INVENTION

1. Technical Field of the Invention

The present invention relates to a sheet feeder unit which supplies cut sheets set in a pile thereon by a feeding roller being contacted to the cut sheets from one side thereof, and particularly to a sheet feeder unit which is capable of separating cut sheets to be supplied one after another by a frictional force generated when a leading end of the cut sheet is pushed forward to contact a friction member which is supported at one end thereof and extended toward a conveying path of the cut sheet. The present invention may be employed for feeding a plurality of piled cut sheets one by one in various appliances such as a copying machine, printer, facsimile machine, or image reading apparatus.

2. Description of Related Art

Japanese published unexamined patent application No.7-196186 discloses such a sheet feeder unit, which is shown in FIG. 7. The feeder unit according to this prior art has a friction member 133 rotatably supported at its lower end by a shaft 132 to be able to stand upright and tilt, and configured to be rectangular when viewed from the front. Each time a feeding roller 131 is rotated round, an uppermost cut sheet 111 is pushed forward so that a whole width of a leading end of the cut sheet 111 comes into frictional contact with the friction member 133 and causes the same to back away against a restoring force of a spring 134 as shown by phantom lines in FIG. 7. The cut sheet 111 is thereby separated from the others and prevented from being supplied one upon another.

In order to assure the separation of cut sheets from each other, the angle $\alpha$ made by a surface of the friction member 133 and an uppermost cut sheet 111 is set within the range of 55° to 85°.

The above mentioned published application also teaches a friction member made of an elastic sheet and fixed at its lower end with the same angular condition as described above, instead of rotatable support by the shaft 132.

The friction member of such configuration, however, requires a very fine adjustment to successfully separate the cut sheets. According to an experiment conducted by the inventors of the present invention, the restoring force of the spring 134 toward its initial position should be set weak to prevent residual deformation of the cut sheet caused by the friction member 133. On the other hand, the restoring force should be strong enough to increase the frictional force between the cut sheet 111 and the friction member 133 so as to ensure the separation. It is difficult to satisfy both of these contradictory conditions. Moreover, the resiliency of cut sheets varies depending on their quality and thickness, causing differences in frictional resistance even with the use of the same friction member.

Also, the friction member 133 in this prior art arrangement is disposed downstream in a feeding direction and away from a nipping position where the feeding roller 131 presses and pushes the cut sheet 111 forward. The cut sheet, when contacted against the friction member 133, is warped and separated from the other. Since the friction member 133 is distanced from the feeding roller 131 widely enough to allow the cut sheet 111 to flexibly deform therebetween, the cut sheet 111 can easily escape from the friction member 133 which is being tilted backward. This configuration helps to prevent residual deformation of the cut sheets 111 irrespective of their thickness.

Still, the sheet feeder unit of this prior art is not fully capable of stably separating cut sheets 111 and sometimes supplies the cut sheets in plural one upon another for the following reasons. Since the friction member 133 has an even surface against which the cut sheet 111 is contacted, the more the leading end of the cut sheet 111 pushes the friction member 133 and approaches a free end thereof, the more the contacting angle therebetween widens, to let the cut sheet 111 to easily slip, causing the frictional force to become less than a desired degree. The cut sheets 111 thus slip through the friction member 133 from time to time without being fully separated from each other. Although the setting of the angle between the cut sheet 111 and the friction member 133 helps to prevent such slippage to some extent, it is not enough to fully prevent faulty feeding of cut sheets, especially of a less resilient type due to their quality or thickness.

BRIEF SUMMARY OF THE INVENTION

In view of the foregoing, it is a primary object of the present invention to provide a sheet feeder unit being capable of successfully separating and supplying cut sheets of any thickness.

To accomplish the said object, the sheet feeder unit of the present invention comprises a support member on which a plurality of sheets piled on one another are loaded; a feeding roller which is contacted to one side of the sheets piled on the support member for causing the sheets to advance in a sheet feeding direction; and a friction member being supported at one end and having a plurality of frictional portions which are capable of contacting a leading edge of the sheets sent out by the feeding roller in the sheet feeding path.

According to such arrangement of the present invention, the leading edge of the sheet is provided with necessary frictional force of contact until it is freed from the tip of the friction member, by each of the frictional portions respectively deforming according to the intricate curve of the cut sheet, whereby the sheets of any thickness can be positively separated from each other without residual deformation and stably supplied one by one.

Other and further objects, features and advantages of the invention will appear more fully from the following description.

BRIEF DESCRIPTION OF THE DRAWINGS

FIG. 5 is an explanatory view for theoretically explaining the separation of cut sheets by the friction member according to the present invention, in which

FIG. 6A is a front view showing the friction member installed in the sheet feeder unit of FIG. 1, and FIG. 6B is a sectional view thereof taken in the direction of the arrows along the line A—A in FIG. 6A; and FIG. 7 is a sectional view showing a conventional sheet feeder unit.

DETAILED DESCRIPTION OF THE INVENTION

Preferred embodiments of the present invention will be hereinafter described in conjunction with the accompanying drawings.

First Embodiment

Figure 2:
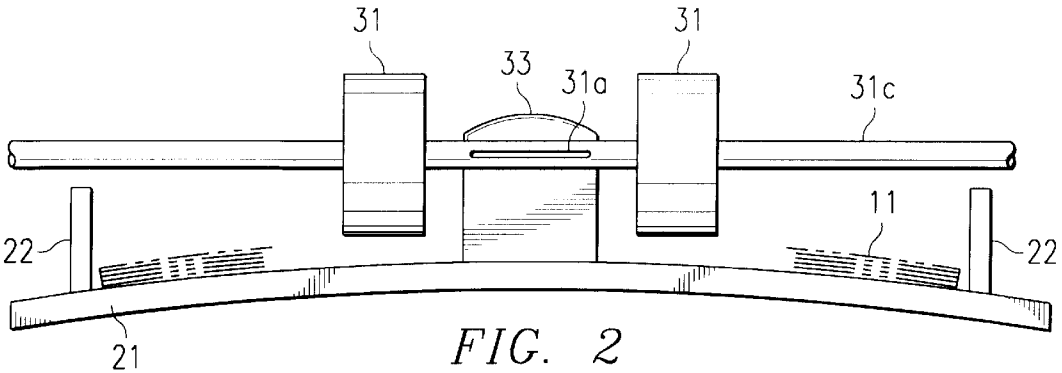
FIG. 2 is a front view showing a feeder tray and a friction member installed in the sheet feeder unit of FIG. 1.
Figure 3:
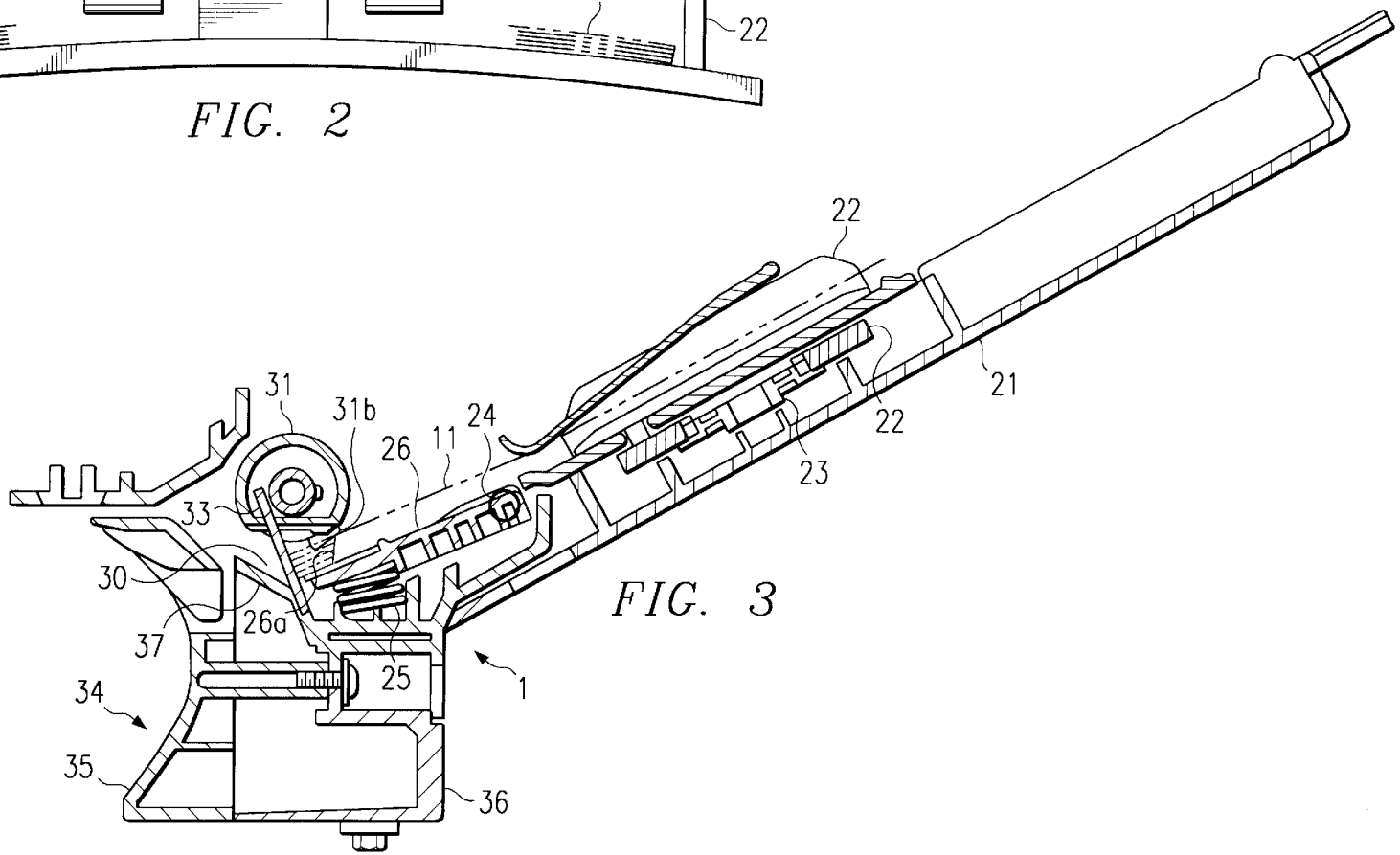
FIG. 3 is a sectional view of an entire body of the sheet feeder unit of FIG. 1.
Figure 4:
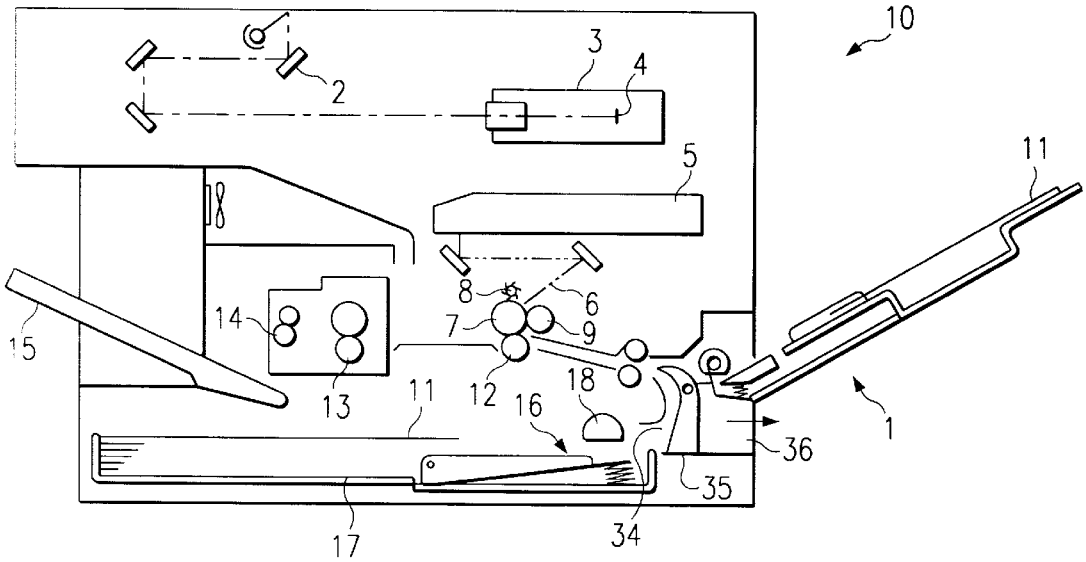
FIG. 4 is a schematic view showing the structure of a copying machine in which the sheet feeder unit of FIG. 1 is incorporated.

A first embodiment of the present invention is shown in FIGS. 1 to 5, and implemented as a sheet feeder unit 1 for supplying recording sheets in a digital copying machine 10 as shown in FIG. 4. An original document which is either manually placed on a platen glass or automatically fed by a document feeding apparatus (not shown) is scanned by a scanning optical system 2. A scanned image is formed in an image sensor 4 in an image reader unit 3, which is converted into electrical image signals to be transmitted to a print head 5. The print head 5 projects out a laser beam 6 modulated by the image signals onto a photosensitive drum 7 to expose the image.

The photosensitive drum 7 is positioned substantially at the center of the main body of the copying machine 10, and its surface is evenly charged by a charging brush 8 for the exposure of the image. An electrostatic latent image formed on the charged surface of the photosensitive drum 7 is developed with toners in a developing unit 9 to be a visible image, which is transferred onto a cut sheet 11 conveyed from the sheet feeder unit 1 by a transfer roller 12 or the like. The cut sheet 11 is then carried to a fixing unit 13 to fix the transferred image thereon, after which the cut sheet 11 is discharged onto a discharge tray 15 directly or being guided by a discharge roller 14.

The copying machine 10 is provided with a sheet feeding apparatus 16 at its bottom for supplying cut sheets 11 of a standardized type or sheets commonly used, which comprises an extractable feeder cassette 17 and a feeding roller 18 mounted in the main body of the copying machine 10 for pushing the sheets forward. While the sheet feeding apparatus 16 is built in the copying machine 10, the sheet feeder unit 1 is a cassette type sheet feeder on which recording sheets are manually placed, and thus projected from a side of the copying machine 10. The sheet feeder unit 1 is intended for use when it is desired to feed one or a plurality of cut sheets 11 of different quality or size which are not prepared in the main body of the copying machine 10.

Referring to FIG. 3, the sheet feeder unit 1 has a pair of side guides 22 provided at both sides of its feeder tray 21, the positions of which are adjustable according to a width of the cut sheets 11 corresponding to various different sizes thereof. Both side guides 22, 22 are connectively moved with each other by a linking gear 23 within the feeder tray 21, so that the cut sheet 11 of any size is always centered on the feeder tray 21.

The sheet feeder unit 1 of such cassette type is suitable for various kinds of cut sheets 11 including postcards, plastic sheets for OHP, very thin sheets, or other unexpected types of sheets.

The sheet feeder unit 1 is desired to have high sheet feeding performance and to be capable of feeding any type of cut sheets 11, while its sheet feeding mechanism must be simple and compact, as the cassette type sheet feeder is one of the fittings which are not very frequently used. While being highly capable of stably feeding any type of cut sheets 11, the sheet feeder unit 1 of the first embodiment is as simply constructed as the above mentioned prior art, in which the outermost cut sheet 11 pushed forward by the feeding roller 31, comes into contact with and causes the friction member 33 to back away, which prevents the other cut sheets from proceeding with the outermost cut sheet 11 by the frictional contact therebetween. It will be understood that the present invention may be applied to a sheet feeding apparatus commonly used and built in the copying machine, an automatic sheet feeder, or to any other appliances.

The feeding roller 31 of the sheet feeder unit 1 is disposed on a side face of the main body of the copying machine 10. The feeder tray 21 extends laterally and upwardly from a base 36 with an outer guide 35 which defines a sheet conveying path 34 for guiding a cut sheet 11 fed from the sheet feeding apparatus 16 toward the photosensitive drum 7. The base 36 is connected to the main body of the copying machine 10 by a hinge (not shown) at its one side, around which the base 36 is rotated together with the feeder tray 21 to open/close the sheet conveying path 34 for removing jammed paper.

The feeder tray 21 has a plate 26 which is rotatably supported by a shaft 24 at its one end and urged upward by a spring 25. The plate 26 presses the pile of cut sheets 11 on the feeder tray 21 toward the feeding roller 31, which pushes the outermost or uppermost cut sheet 11 forward by its rotation. The surface of the feeding roller 31 is made of rubber such as ethylene propylene diene monomer (EPDM) or the like to provide an appropriate amount of frictional force. The material of the feeding roller 31 is of course not limited to the one mentioned above.

The feeding roller 31 is configured to be semicircular in cross section, the cutaway flat portion of which is usually faced with the cut sheets 11, and the feeding roller 31 is rotated round to cause its semicircular periphery to contact with the cut sheet 11 to send it out. When the sheets are not to be fed, a cam 31*b* which is rotated in synchronism with the feeding roller 31 is contacted with a cam follower 26*a* , which presses down the plate 26 against the force of the spring 25, to bring the cut sheets 11 apart from the feeding roller 31, so that the pile of cut sheets 11 can be readily placed at a predetermined location on the feeder tray 21 by hand where the cut sheets 11 come to contact with the friction member 33, or removed the same therefrom.

At the time of feeding sheets, when the feeding roller 31 is started to rotate, the cam 31*b* comes apart from the cam follower 26*a* at the same time or slightly after the cutaway portion of the feeding roller 31 comes out of opposition to the cut sheets 11. The plate 26 being freed is thus pushed upward by the spring 25 to press the cut sheets 11 onto the periphery of the rotating feeding roller 31.

The friction member 33 of this embodiment is made of an elastic sheet, so that the friction member 33 can be elastically deformed to warp when the cut sheet 11 is sent out by the friction roller 31. The feeding member stops the cut sheets 11 except the uppermost one, thereby separating the cut sheets 11 from each other by the frictional contact therebetween and supplies the cut sheets one by one from the uppermost side thereof. For this reason, the friction member 33 is extended from the lowermost side of the pile of cut sheets 11 toward a conveying path 30 of the cut sheets, with its lower end fixedly connected to a support wall 37 standing upright under the conveying path 30 by any appropriate manners such as bonding or bolting.

The mechanism of how the friction member 33 separates the cut sheets can be theoretically and quantitatively explained by the combination of the backing away movement of the friction member 33 and partial deformation of the cut sheets as follows.

Figure 5A:
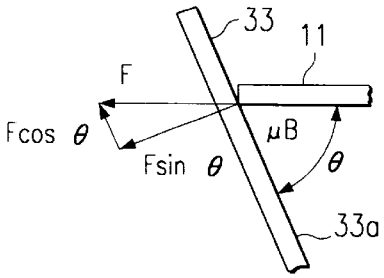
FIG. 5A is a sectional view.

FIG. 5A shows a state where the force F of proceeding cut sheet 11 balances the frictional force on the surface 33*a* of the friction member 33, which is expressed by an equation $$F \cos \theta = \mu_B \cdot F \sin \theta \text{ ---} \quad (1)$$

where $\mu_B$ is a friction coefficient of the frictional surface 33*a* with respect to the cut sheet 11, and θ (fixed value) is the angle made between the cut sheet 11 and the frictional surface 33*a*. From above, the following relations are derived.

$$\mu_B \cdot \tan \theta < 1 \text{ (cut sheet proceeds) ---} \quad (2)$$

$$\mu_B \cdot \tan \theta \geqq 1 \text{ (cut sheet stops) ---} \quad (3)$$

Figure 5B:
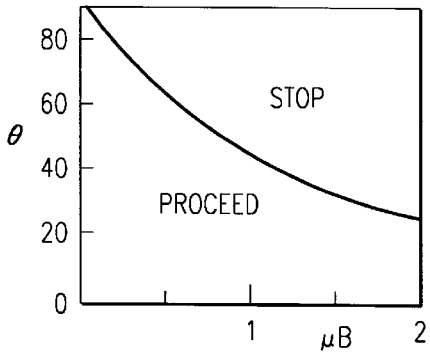
FIG. 5B is a graph showing a boundary condition whether the cut sheet stops or proceeds when contacted against the friction member.

FIG. 5B shows critical angles of contacting angle θ within the range of appropriate friction coefficient $\mu_B$ where the cut sheet 11 slips to proceed.

It can be seen from the above inequalities (2),(3) that, theoretically, whether the cut sheet 11 proceeds or not does not depend on the force F but on the values of the friction coefficient $\mu_B$ and the angle θ. Thus, if the $\mu_B$ is invariable, it is necessary to give a difference in the contacting angle θ between the outermost cut sheet 11 and the other cut sheets 11 with respect to the frictional surface 33*a*. In other words, the outermost cut sheet 11 can be separated by changing the contacting angle θ from the "STOP" area to the "PROCEED" area of the graph shown in FIG. 5B.

However, the cut sheets 11 are normally placed in a pile in tight contact with each other and there is virtually no difference in the angle θ made by each cut sheet 11 and the frictional surface 33*a*.

The friction member 33, while being pushed back by the advancing cut sheet 11, causes the outermost cut sheet 11 to curve by the frictional force of contact more than the other following cut sheets 11, so that the angle θ made by the outermost cut sheet 11 and the frictional surface 33*a* becomes much acuter than that of the other cut sheets 11, thus separating the cut sheets 11 from each other and allowing only the outermost cut sheet to pass through while stopping the others.

Nevertheless, it is still difficult to ensure that the cut sheets 11 are fed one by one without any residual deformation which may be caused by too much force from the friction member 33, because the resiliency of cut sheets varies depending on their type, quality, and thickness.

The friction member 33 in this embodiment may be, for example, made of a polycarbonate film with a thickness of 200 micrometers which may be available on the market, to provide enough restoring force. The frictional surface 33*a* is provided with a necessary friction coefficient by coating the surface of polycarbonate film with a material having a high friction coefficient such as urethane resin by a silk screen printing method or the like. The frictional surface 33*a* may preferably have about a 1.0 to 1.5 static friction coefficient with respect to standard fine paper. It is also preferable that the angle made by the frictional surface 33*a* and the uppermost cut sheet 11 is determined within the range of 90° to 120°.

In this embodiment, the feeding roller 31 is provided in a pair as shown in FIG. 2, at symmetrical positions about the center of the sheet conveying path of the cut sheets 11, so as to advance the cut sheets without skew. The pair of feeding rollers 31 allows the cut sheets 11 which may be not centered on the feeder tray 21 depending on their size to be also fed without skew.

The friction member 33 may be disposed in the middle between the pair of feeding rollers 31, in which case the force of advancing the cut sheets 11 by the feeding rollers 31 is exerted to the central area of the cut sheets, allowing the cut sheets 11 to naturally deform to be convex in a direction of width, without causing the cut sheets 11 to be skewed. The same is applied to a case in which a multiple pairs of feeding roller 31 are provided. If there is only one feeding roller 31 provided, friction pieces may be preferably provided at both sides of the feeding roller. In the case that the feeding roller 31 is eccentrically disposed or mounted in plurality at various positions, the friction pieces may be provided in a corresponding number at corresponding positions to balance the feeding rollers 31.

When the friction member 33 is disposed in the middle between the pair of feeding rollers 31, the friction member is preferably formed to be widthwise convex.

By having the frictional surface 33*a* convexly formed which coincides with the curve of the cut sheets 11 naturally deformed when being advanced, a leading end of the cut sheet 11 is kept properly curved under a favorable amount of frictional force until it is brought apart from the edge of the friction member 33, even though the contacting angle between the cut sheet 11 and the frictional surface 33*a* becomes more acute as the cut sheet 11 advances. A cut sheet of any type can be thereby separately fed without residual deformation irrespective of its thickness.

Figure 1:
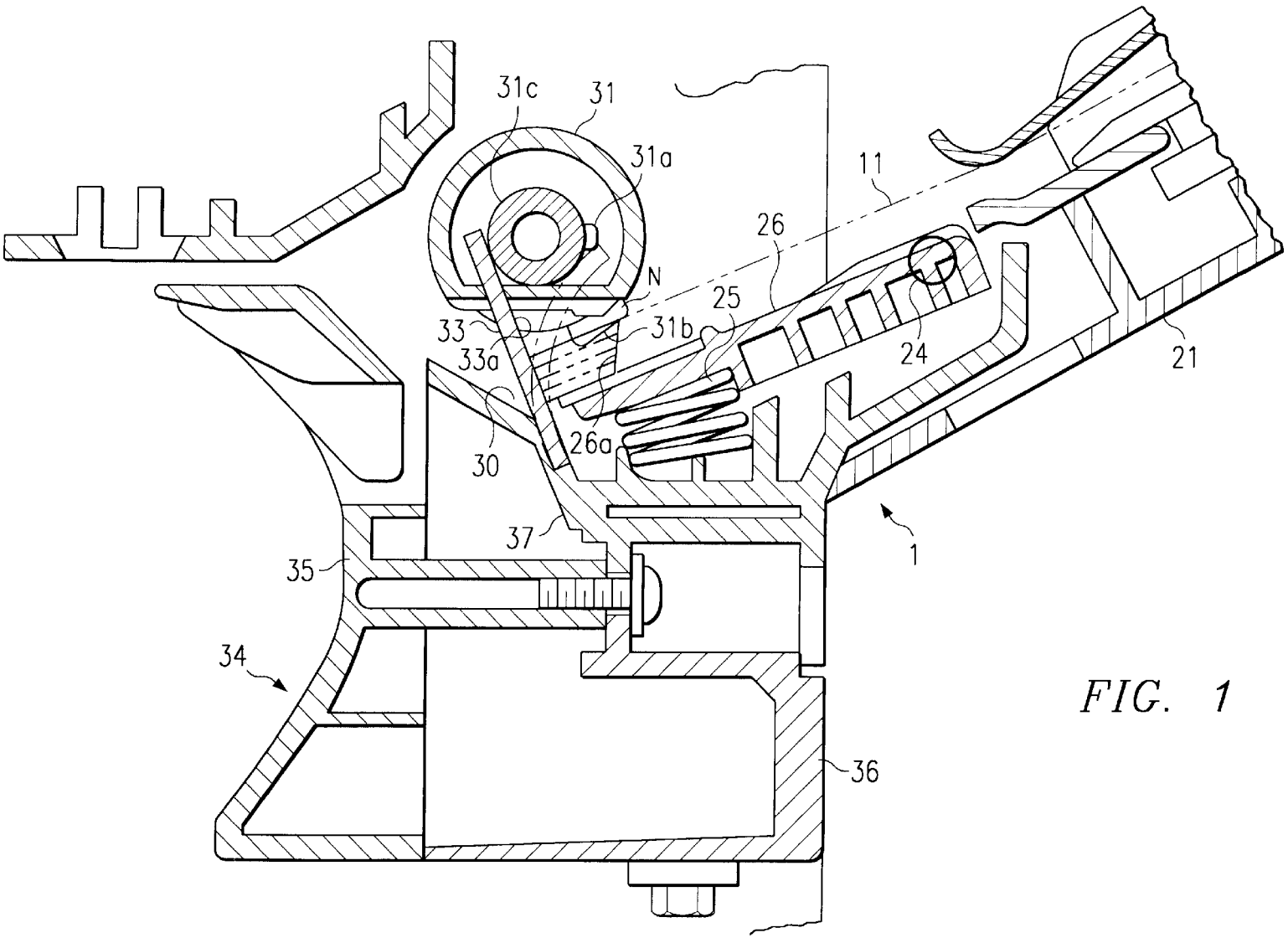
FIG. 1 is a sectional view showing primary parts of a sheet feeder unit according to first and second embodiments of the present invention.

Furthermore, the frictional surface 33*a* is positioned within the area defined by the outside dimension of the feeding rollers 31 as can be seen from FIG. 1, where the cut sheet 11 comes to frictional contact with the friction member 33. The distance between the frictional surface 33*a* and a nipping position N where the feeding rollers 31 contact to advance the cut sheet 11 is much smaller than that of the prior art arrangement described above. The cut sheet 11 between the nipping position and the frictional surface 33*a* is restrained from being unfavorably deformed to ensure that the cut sheet 11 is received by the friction member 33 with an appropriate amount of frictional force, enhancing the performance of the friction member 33 and allowing it to be suitable for high-speed feeding. Favorable results were obtained by determining the angle of the friction member 33 in the manner described above.

However, when the friction member 33 is disposed so near the feeding rollers 31 as in this arrangement, the leading end of the cut sheet 11 would locally receive bending stress if a friction member 33 of rectangular shape as in the prior art was employed. Cut sheets having less resiliency or those downwardly curved might be bent at their leading ends. The friction member 33 according to this embodiment of the present invention is, for that reason, formed to be convex in a widthwise direction, thus being able to smoothly guide the cut sheets along a curved line of natural deformation thereof, decreasing any damages thereto.

It is even more preferable that the feeder tray 21 on which the cut sheets 11 are piled is also formed convexly in the same direction as that of the frictional surface 33*a* so as to hold the cut sheets 11 in a posture close to the one expected to be after being naturally deformed, in order to lessen the damage to the cut sheets 11.

When the feeding roller 31 is given one turn to send out one cut sheet 11 and the rear end of the cut sheet 11 is passed through the nipping position N, the friction member 33 is released from the pressing force of the cut sheet 11 and returned to its initial position. Other cut sheets 11 following the previously fed cut sheet 11 are pushed back by the rebounding force of the friction member 33 to prevent them from becoming obstructions to the succeeding sheet feeding. The friction member 33 with the prescribed angle condition successively accomplishes such object.

When the base 36 of the sheet feeder unit 1 is opened to reveal the sheet conveying path 34, the friction member 33 is forwardly drawn out, slipping under a rotating shaft 31*c* of the feeding rollers 31. The rotating shaft 31*c* thus obstructs the friction member 33 returning to its initial position as shown by a phantom line in FIG. 1, when the base 36 is closed. For that reason, a boss 31*a* is provided on the rotating shaft 31*c* which catches the tip of the friction member 33 to push it back to the position denoted by the solid line when the feeding rollers 31 are rotated to start feeding sheets, thus ensuring automatic restoration of the friction member 33 to its proper position.

Second Embodiment

A second embodiment of the present invention is also implemented as a sheet feeder unit 1 incorporated in a copying machine 10 as shown in FIG. 4 for feeding recording sheets, and is shown in FIG. 6.

The frictional surface 33*a* of the friction member 33 according to the second embodiment is different from that of the first embodiment in that it is divided into pieces in a widthwise direction. Other elements are identical to those of the first embodiment and will be described in no more detail.

Referring to FIG. 6A, the friction member 33 of a width of about 32 mm is divided into four pieces 33*a*1, 33*a*2, 33*a*3, and 33*a*4, which are aligned in a direction of contact between the frictional surface 33*a* and the outermost cut sheet 11 to appear like teeth of a comb.

Figure 5C:
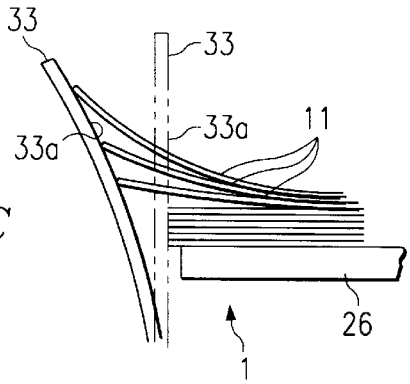
FIG. 5C is a conceptualistic view showing the way how the cut sheets are loosened with the friction member.

According to this arrangement, when the cut sheet 11 is advanced by the feeding rollers 31 to push back the friction member 33 and as the contacting angle made by the frictional surface 33*a* and the cut sheet 11 becomes smaller and smaller as shown in FIG. 5*c*, each of the friction pieces 33*a*1 to 33*a*4 respectively warps corresponding to the intricate deformation at the leading end of the cut sheet 11, so as to keep the cut sheet 11 favorably curved with a necessary amount of frictional force. Accordingly, any type of cut sheets of various thicknesses can be successfully separated without residual deformation.

The friction member 33 is so constructed that, when viewed from a side, the friction pieces 33*a*1 to 33*a*4 appear longitudinally shifted away from each other. More particularly, the inner friction pieces 33*a*2 and 33*a*3 are disposed about 20 micrometers, which is substantially the same as the thickness width of the friction pieces, forward the outer friction pieces 33*a*1 and 33*a*4 as can be seen from FIG. 6B. This arrangement enables a two step separation of cut sheets 11, i.e., the front friction pieces 33*a*2 and 33*a*3 first cause the cut sheet 11 to curve and the back friction pieces 33*a*1 and 33*a*4 assist the front pieces to separate the cut sheet 11 which was not fully separated in the first step by the front friction pieces 33*a*2, 33*a*3. Preferably, the surface area of the friction surface 33*a* required for separation of the cut sheets 11 is furnished by a summed area of the front friction pieces 33*a*2 and 33*a*3.

As in the first embodiment, the frictional surface 33*a* is positioned within the area defined by the outside dimension of the feeding rollers 31 as can be seen from FIG. 1. The distance between the frictional surface 33*a* and the nipping position N is so small that the cut sheet 11 is prevented from being unfavorably deformed to ensure that the cut sheet 11 is received by the friction member 33 with an appropriate amount of frictional force, enhancing the performance of the friction member 33 and allowing it to be suitable for high-speed feeding. Favorable results were obtained by determining the angle of the friction member 33 in the manner described above.

If a single piece friction member of the prior art was employed, the leading end of the cut sheet 11, especially of less resilient type, might be locally bent by the bending stress exerted thereto. The friction member 33 according to the second embodiment of the present invention has a plurality of surfaces 33*a* divided into friction pieces 33*a*1 to 33*a*4, which help to disperse the bending stress to prevent crooked deformation of the cut sheet 1 at its leading end.

When the feeding roller 31 is given one turn to send out one cut sheet 11 and the rear end of the cut sheet 11 is passed through the nipping position N, the friction member 33 is released from the pressing force of the cut sheet 11 and returned to its initial position. Other cut sheets 11 following the previously fed cut sheet 11 are pushed back by the rebounding force of the friction member 33 to prevent them from becoming obstructions to the succeeding sheet feeding. The friction member 33 with the prescribed angle condition successively accomplishes such object.

Further, the feeding roller 31 is provided in a pair on both sides of a center of the sheet conveying path as the cut sheets 11 are aligned along their center line, whereby the cut sheets 11 are fed without skew. Even when the cut sheet 11 aligned along its one side is of such size that the feeding rollers 31 touch the sheet at a position away from the center, sheet feeding by the feeding rollers 31 is stably achieved without skew due to the provision of the feeding rollers in a pair.

When the feeding rollers 31 are provided in a pair as described above, some or all of the friction pieces constituting the frictional surface 33*a* may be positioned in the middle between the pair of feeding rollers 31. For example, all of the four friction pieces 31*a*1 to 31*a*4 are disposed at the center in FIG. 6A, and two other friction pieces 33*a*5 and 33*a*6 are additionally provided at both outer sides of each feeding roller 31. In such a case, the sheet feeding force of the pair of feeding rollers 31 is exerted to a center of the cut sheets 11 causing the sheet to convexly deform in a widthwise direction and a friction resistance generated between the feeding rollers and the cut sheets does not cause any skew of the sheets. The same is applied to a case where a plurality of pairs of feeding rollers are provided. When there is only one feeding roller 31 provided, the frictional pieces may preferably be disposed on either side of the feeding roller 31.

In case that the feeding roller 31 is eccentrically disposed or mounted in plurality at various positions, the friction pieces may be provided in a corresponding number at corresponding positions to balance the feeding rollers 31.

When the friction pieces 33*a*1 to 33*a*4 which form in a combination the frictional surface 33*a* of the friction member 33 are arranged in the middle between the pair of feeding rollers 31, the friction pieces 33*a*1 to 33*a*4 may preferably be so formed that the inner pieces are higher than the outer pieces as shown in FIG. 6A, so as to guide the cut sheets 11 smoothly along their deformed curve.

The description of other effects and advantages of the second embodiment will be omitted as they are substantially identical to those of the first embodiment.

The present invention has been described with respect to a sheet feeder unit which feeds sheets from the top side, but it is of course possible to apply the present invention to a sheet feeder unit sending out sheets from the bottom side.

Although the present invention has been fully described by way of examples with reference to the accompanying drawings, it is to be noted that various changes and modifications will be apparent to those skilled in the art. Therefore, unless otherwise such changes and modifications depart from the scope of the present invention, they should be construed as being included therein.

What is claimed is:

1. A sheet feeder unit comprising:

a support member on which a plurality of sheets piled on one another are loaded;

a feeding roller which is contacted to one side of the sheets piled on the support member for causing the sheets to advance in a sheet feeding direction; and a friction member being supported at one end and having a plurality of frictional portions spaced in a widthwise direction of the sheets which are capable of contacting a leading edge of the sheets sent out by the feeding roller in a sheet feeding path, wherein each of the plurality of frictional portions is supported at various different positions in a widthwise direction of sheets for respectively contacting the leading edge of the sheets and can be separately displaced, and wherein, the plurality of frictional portions are supported at various different positions in a sheet conveying direction so that the frictional portions come to contact with the leading edge of the sheet at different timings.

2. A sheet feeder unit comprising:

a support member on which a plurality of sheets piled on one another are loaded;

a feeding roller which is contacted to one side of the sheets piled on the support member for causing the sheets to advance in a sheet feeding direction; and a friction member being supported at one end and having a plurality of frictional portions spaced in a widthwise direction of the sheets which are capable of contacting a leading edge of the sheets sent out by the feeding roller in a sheet feeding path, wherein each of the plurality of frictional portions is supported at various different positions in a widthwise direction of sheets for respectively contacting the leading edge of the sheets and can be separately displaced;

wherein the plurality of frictional portions are supported at various different positions in a sheet conveying direction so that the frictional portions come to contact with the leading edge of the sheet at different timings; and wherein, among the plurality of frictional portions, ones which come to contact with the leading edge of the sheet earlier have longer frictional surfaces.

3. A sheet feeder unit comprising:

a support member on which a plurality of sheets piled on one another are loaded;

a feeding roller which is contacted to one side of the sheets piled on the support member for causing the sheets to advance in a sheet feeding direction; and a friction member being supported at one end and having a plurality of frictional portions spaced in a widthwise direction of the sheets which are capable of contacting a leading edge of the sheets sent out by the feeding roller in a sheet feeding path.

wherein each of the plurality of frictional portions is supported at various different positions in a widthwise direction of sheets for respectively contacting the leading edge of the sheets and can be separately displaced;

wherein the feeding roller comprises a first contact portion and a second contact portion arranged in parallel in the widthwise direction of sheets and the plurality of the frictional portions are disposed between the first and second contact portions of the feeding roller in the widthwise direction of sheets; and wherein, among the plurality of frictional portions, frictional portions which are located nearer to a central position between the first and second contact portions of the feeding roller have longer frictional surfaces than frictional portions which are located farther from the central position.

4. A sheet feeder unit comprising:

a support member on which a plurality of sheets piled on one another are loaded, said support member having a sheet supporting surface configured to be convex at a central part thereof in the widthwise direction of the sheets;

a first feeding roller which is contacted to one side of the sheets piled on the support member for causing the sheets to advance in a sheet feeding direction;

a second feeding roller supported around an identical shaft of the first feeding roller and contacted to the one side of the sheets piled on the support member for causing the sheets to advance in the sheet feeding direction; and a friction member supported at one end and disposed between the first feeding roller and the second feeding roller in a widthwise direction of sheets and provided with a frictional portion which is capable of contacting a leading edge of the sheets sent out by the first and second feeding rollers in a sheet feeding path, the frictional portion being longer at a central part thereof at the middle of the widthwise direction of sheets.

5. A sheet feeding unit according to claim 4, wherein the first and second feeding rollers have an outer dimension; and the frictional portion of the friction member is supported for contacting the leading edge of the sheets at a position within an area defined by the outer dimension of the first and second feeding rollers.

* * * * *